US010219611B2

(12) United States Patent
Simeth et al.

(10) Patent No.: US 10,219,611 B2
(45) Date of Patent: Mar. 5, 2019

(54) HEAD FOR AN ORAL-CARE IMPLEMENT AND ORAL-CARE IMPLEMENT

(71) Applicant: The Procter & Gamble Company, Cincinnati, OH (US)

(72) Inventors: Martin Simeth, Königstein (DE); Georges Driesen, Kronberg (DE)

(73) Assignee: The Procter & Gamble Company, Cincinnati, OH (US)

( * ) Notice: Subject to any disclaimer, the term of this patent is extended or adjusted under 35 U.S.C. 154(b) by 272 days.

(21) Appl. No.: 15/048,678

(22) Filed: Feb. 19, 2016

(65) Prior Publication Data

US 2016/0242536 A1 Aug. 25, 2016

(30) Foreign Application Priority Data

Feb. 19, 2015 (EP) ..... 15155773

(51) Int. Cl.
*A46B 3/16* (2006.01)
*A46B 9/04* (2006.01)
*A46D 1/00* (2006.01)

(52) U.S. Cl.
CPC ..... *A46B 9/04* (2013.01); *A46B 3/16* (2013.01); *A46D 1/0238* (2013.01); *A46D 1/0253* (2013.01); *A46B 2200/1066* (2013.01)

(58) Field of Classification Search
CPC .... A46B 3/16; A46B 9/04; A46D 1/02; A46D 1/0238; A46D 1/0253; A46D 1/0269
USPC ..... 15/167.1, 195, 196, 199, 207.2
See application file for complete search history.

(56) References Cited

U.S. PATENT DOCUMENTS 2,317,485 A * 4/1943 Rider ..... A46D 1/00 15/167.1
5,850,660 A * 12/1998 O'Halloran ..... A46B 3/16 15/167.1
6,094,769 A * 8/2000 Driesen ..... A46D 1/00 15/167.1
2007/0289078 A1* 12/2007 Driesen ..... A46D 1/00 15/207.2

(Continued)

FOREIGN PATENT DOCUMENTS

CN 1205191 A 1/1999
EP 0453954 A1 10/1991

(Continued)

OTHER PUBLICATIONS

European Search Report for EP15155773.3 dated Aug. 28, 2015.

*Primary Examiner* — Mark Spisich
(74) *Attorney, Agent, or Firm* — Parker D. McCrary; Vladimir Vitenberg

(57) ABSTRACT

A head for an oral-care implement having a longitudinal axis and comprises a bristle carrier having at least one tuft hole and at least one tuft being fixed in said tuft hole by an anchor. The at least one tuft comprises at least one filament having a longitudinal axis and a non-circular cross-sectional area extending in a plane substantially perpendicular to the longitudinal axis. The at least one filament is bent around the anchor so that a first limb and a second limb extend from the bristle carrier. The first limb comprises a first free end, and the second limb comprises a second free end. Each free end is twisted around the longitudinal axis by a twisting angle α of about 80° to about 100°, preferably about 90°.

15 Claims, 4 Drawing Sheets

(56) References Cited

U.S. PATENT DOCUMENTS

| | | | | |
|---|---|---|---|---|
| 2012/0204371 | A1* | 8/2012 | Chun | A46B 9/028<br>15/167.1 |
| 2016/0015163 | A1* | 1/2016 | Newman | A46B 9/06<br>15/167.1 |

FOREIGN PATENT DOCUMENTS

| | | | | |
|---|---|---|---|---|
| EP | 663162 | | * | 7/1995 |
| JP | H03000823 | U | | 1/1991 |
| JP | 3-289906 | | * | 12/1991 |
| JP | H08502908 | A | | 4/1996 |
| JP | 10-313946 | | * | 12/1998 |
| JP | H10327931 | A | | 12/1998 |
| JP | 11-290133 | | * | 10/1999 |
| JP | 2001-169829 | | * | 6/2001 |
| JP | 2002360342 | | * | 12/2002 |
| JP | 20023360342 | A | | 12/2002 |
| JP | 2003019030 | | | 1/2003 |
| JP | 2006223426 | A | | 8/2006 |
| JP | 2009-219520 | | * | 10/2009 |
| KR | 20100118916 | A | | 11/2010 |

* cited by examiner

HEAD FOR AN ORAL-CARE IMPLEMENT AND ORAL-CARE IMPLEMENT

FIELD OF THE INVENTION

The present disclosure is concerned with a head for an oral-care implement and in particular with such a head comprising at least one tuft of filaments having a non-circular cross-sectional area.

BACKGROUND OF THE INVENTION

Tufts composed of a plurality of filaments for oral-care implements, like manual and powered toothbrushes, are well known in the art. Generally, the tufts are attached to a bristle carrier of a head intended for insertion into a user's oral cavity. A grip handle is usually attached to the head, which handle is held by the user during brushing. The head is either permanently connected or repeatedly attachable to and detachable from the handle.

It is known that tufts are typically composed of filaments which have a substantially circular cross-sectional area and which extend substantially in the same direction in a substantially straight manner. This type of filament show substantially isotropic bending stiffness. However, on the one hand, relatively low bending stiffness results in reduced plaque removal efficiency on teeth surfaces, as well as in less interdental penetrations properties and cleaning performance. On the other hand, in case the bending stiffness is relatively high, a risk may occur to injure the gums of a user.

Further, filaments having a profile along their length extension resulting in a non-circular cross-sectional area, e.g. a polygonal cross-sectional area, are also known in the art. Such filaments should improve cleaning properties of oral-care implements during normal use. In particular, the profiled edges should provide a stronger scraping action during a brushing process to improve removal of plaque and other residuals on the teeth surfaces.

While toothbrushes comprising these types of filaments clean the outer buccal face of teeth adequately, they are generally not as well suited to provide adequate removal of plaque and debris from the gingival margin, interproximal areas, lingual surfaces and other hard to reach areas of the mouth.

It is an object of the present disclosure to provide a head for an oral-care implement which provides improved cleaning properties, for example with respect to interproximal and gingival marginal regions of teeth. It is also an object of the present disclosure to provide an oral-care implement comprising such head.

SUMMARY OF THE INVENTION

In accordance with one aspect, a head for an oral-care implement is provided that comprises:

- a bristle carrier having at least one tuft hole and at least one tuft being fixed in said tuft hole by an anchor,
- the at least one tuft comprising at least one filament having a longitudinal axis and a non-circular cross-sectional area extending in a plane substantially perpendicular to the longitudinal axis,
- the at least one filament being bent around the anchor so that a first limb and a second limb extend from the bristle carrier,
- the first limb comprising a first free end and the second limb comprising a second free end, wherein
- each free end is twisted around the longitudinal axis by a twisting angle $\alpha$ of about 80° to about 100°, preferably about 90°.

In accordance with one aspect, an oral-care implement is provided that comprises such head.

BRIEF DESCRIPTION OF THE DRAWINGS

The invention is described in more detail below with reference to various embodiments and figures, wherein.

DETAILED DESCRIPTION OF THE INVENTION

Figure 1:
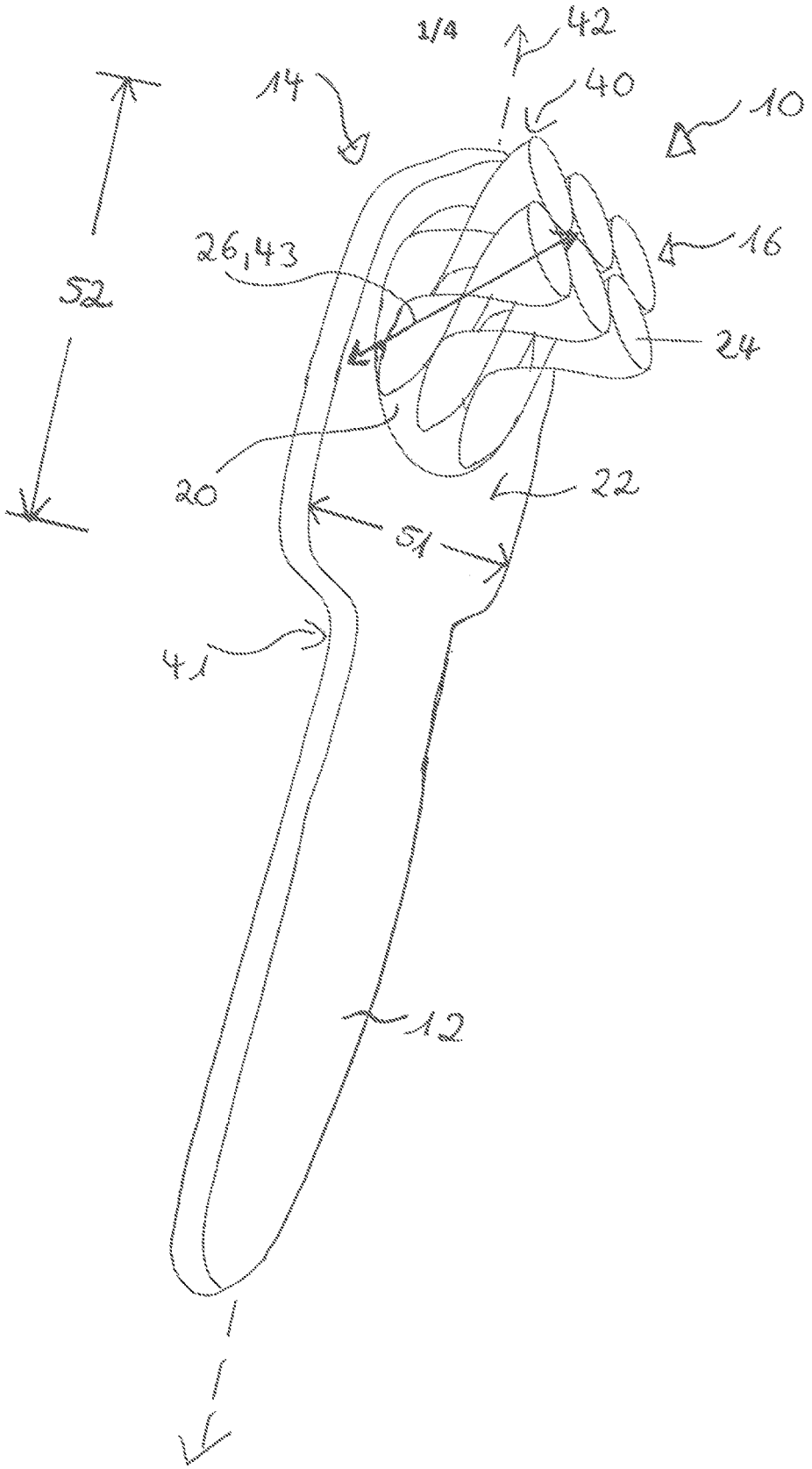
FIG. 1 shows a schematic perspective view of an example embodiment of an oral-care implement comprising a first example embodiment of a tuft having a plurality of filaments.

A head for an oral-care implement in accordance with the present disclosure comprises a bristle carrier being provided with at least one tuft hole, e.g. a blind-end bore. A tuft comprising a plurality of filaments is fixed/anchored in said tuft hole by a stapling process/anchor tufting method. This means, that the filaments of the tuft are bent/folded around an anchor, e.g. an anchor wire or anchor plate, for example made of metal, in a substantially U-shaped manner. The filaments together with the anchor are pushed into the tuft hole so that the anchor penetrates into opposing side walls of the tuft hole thereby anchoring/fixing/fastening the filaments to the bristle carrier. The anchor may be fixed in the opposing side walls by positive and frictional engagement. In case the tuft hole is a blind-end bore, the anchor holds the filaments against a bottom of the bore. In other words, the anchor may lie over the U-shaped bend in a substantially perpendicular manner. Since the filaments of the tuft are bent around the anchor in a substantially U-shaped configuration, a first limb and a second limb of each filament extend from the bristle carrier in a filament direction. Filament types which can be used/are suitable for usage in a stapling process are also called "two-sided filaments". Heads for oral-care implements which are manufactured by a stapling process can be provided in a relatively low-cost and time-efficient manner.

The tuft being fixed in the tuft hole comprises at least one filament having a longitudinal axis and a non-circular cross-sectional area extending in a plane substantially perpendicular to the longitudinal axis. The shape and size of the cross-sectional area may be substantially constant along the longitudinal axis of the filament. The first limb and the second limb comprise a first free end and a second free end, respectively. During a brushing action, the free ends usually come in direct contact with the teeth surfaces and/or gums. In order to avoid injuries of the oral cavity and to provide gentle cleaning properties, the free ends of the filament may be end-rounded. End-rounded ends may avoid that gums get injured during brushing.

In order to clean the teeth effectively, appropriate contact pressure has to be provided between the free ends of the filaments and the teeth. Generally, the contact pressure depends on the bending stiffness and the displacement of the filaments, while the bending stiffness of a single filament depends on its length and cross-sectional area. Usually, filaments with greater length show lower bending stiffness compared to shorter filaments. In order to compensate said reduction in bending stiffness of longer filaments, the size of the cross-sectional area of a filament could be increased. However, relatively thick filaments may create an unpleasant brushing sensation and tend to injure the gums in the oral cavity. In addition, thicker filaments may show reduced bend recovery and usage of said filaments may generate a worn-out impression of the tuft pattern after a relatively short time of use.

In order to overcome this drawback, a filament is provided having a non-circular cross-sectional area. The first free end and the second free end of the filament are each twisted around the filament's longitudinal axis by a twisting angle of about 80° to about 100°, optionally about 90°. In other words, each free end of the filament is twisted along the longitudinal axis with respect to the filament's fixed portion in the tuft hole. The free ends are distorted/rotated/turned around the longitudinal axis of the filament. The first free end and the second free end may be twisted in the same or in opposite directions.

The non-circular shape of the cross-sectional area provides the filament with anisotropic bending stiffness. The stiffness properties of said filament may vary with respect to the brushing direction. Since the cross-sectional area is non-circular, the cross-sectional area comprises a shorter diameter and a longer diameter lying in the plane of said cross-sectional area. The bending stiffness in the direction of the longer diameter is higher compared to the bending stiffness in the direction of the shorter diameter. In case a force is applied in the direction of the longer diameter, contact pressure between the filament's free ends and the teeth surfaces may be increased, which may facilitate plaque removal on the teeth surfaces. Further, the filament's free ends may be forced to penetration into interdental spaces more easily. The filament's free ends may enter with its shorter side i.e. with its shorter diameter interdental spaces more easily. Therefore, plaque and other residues can be removed more effectively without causing an unpleasant brushing sensation or injuries of the gums.

The twisted configuration of the filament according to the present disclosure may further improve cleaning properties of the head, e.g. with respect to interdental areas and gingival marginal regions of the teeth, since the twist may facilitate the filament adapting to the teeth's contour more easily/in a better manner. The filament may assure access to narrow spaces as the stiffness is increased due to the specific twisted configuration. In case pressure is applied to non-twisted filaments, e.g. in the course of a brushing action, these filaments may bend more easily. In contrast thereto, in case pressure is applied to the filament in accordance with the present disclosure, the filament may rather de-twist or may twist further in the direction of twist (depending on the direction of pressure). The de-twisting of the filament may occur via at least a part of the twisting angle $\alpha$ and may result in an elongation of the filament. This elongation may enable the filament to penetrate deeper into interdental areas and other hard to reach regions. The filament may de-twist, elongate and due to the increased length, said filament may assure access to narrow spaces and may be able to penetrate into interdental areas even more deeply and efficiently. In case the filament further twists in the twisting direction, this may result in increased stiffness, leading to higher contact pressure between the filament's free ends and the teeth surfaces which may lead to even better plaque removal on substantially flat or planar surfaces, for example when the head is moved along the occlusal, labial and buccal surfaces of the teeth. The twisted filament according to the present disclosure may allow higher contact pressure/pressing forces during a brushing action. Test results revealed that filaments having a twisted configuration in accordance with the present disclosure reached deeper into interdental areas and adapted better to gingival marginal regions of the teeth compared to regular filaments extending from the bristle carrier of the head in a substantially straight manner.

When fixing the at least one filament or a plurality of said filaments in the tuft hole of the bristle carrier via an anchor, the filaments may orientate/align predominantly in the same manner, i.e. the flat side(s) of the filament(s) may be aligned substantially parallel to the upper top surface of the bristle carrier. In other words, the anchor may lie over the U-shaped bend in a manner that the anchor crosses the longer diameter of the filament's cross-sectional area. In other words, the longitudinal axis of the anchor is substantially parallel to the longer diameter of the non-circular cross-sectional area of the filament. Thus, anisotropic bending properties can be determined by the anchor position in the tuft hole. Since the free ends of the filament are twisted around the longitudinal axis by a twisting angle of about 80° to about 100°, optionally about 90°, the longer diameter of the non-circular cross-sectional area at the filament's free ends are substantially perpendicular to the longitudinal axis of the anchor. In other words, the position of the anchor may align the orientation of the filament's free ends. Due to the twisting angle $\alpha$ of about 80° to about 100°, optionally about 90°, the longer diameter of the cross-sectional area of the filament's first free end and the longer diameter of the cross-sectional area of the filament's second free end are substantially parallel to each other. Since the twist may provide the filament with increased stability, the tendency of filament bending during a brushing action may be reduced. Moreover, the filament according to the present disclosure may provide a more correct filament movement during a brushing action even if a non-optimal brushing technique is applied.

The ratio of the length of the shorter diameter to the length of the longer diameter may be about 0.6 to about 0.8. Surprisingly, it was found out that such ratio may facilitate correct alignment of the filament with respect to the anchor. The filament may be fixed in the tuft hole in a manner that the longer diameter of the cross-sectional area is aligned in the tuft hole substantially parallel to the upper top surface of the bristle carrier. In other words, such ratio may facilitate the anchor crossing the filament along the filament's longer diameter.

For example, the non-circular cross-sectional area of the filament may be oval/ellipsoid, squared, rectangular, triangular, cross-shaped, or it can be a prolate ellipsoid with flattened long sides, even though other shapes may be considered, as well. In case the non-circular cross-sectional area has the shape of an oval, the longest diameter of the cross-sectional area may be substantially parallel to the longitudinal axis of the anchor. Since the filament's bending stiffness is increased in the direction of the longer diameter, the filament's free ends may enter interdental spaces with its shorter sides more easily.

The head for the oral-care implement may have a longitudinal axis/extension being defined as the axis/extension between a proximal end and a distal end of the head. In the context of this disclosure the term "proximal end" means the end of the head which may be attached or attachable to a handle of an oral-care implement, whereas the term "distal end" means the end of the head being opposite the proximal end, i.e. being furthest away from the handle/at the loose/free end of the head. A longitudinal brushing direction is defined by a brushing movement in the direction towards the distal end or towards the proximal end of the head, i.e. along the longitudinal extension of the head.

The first free end and the second free end of the at least one filament may be arranged in a manner that the longer diameter of the cross-sectional area at the first free end and the longer diameter of the cross-sectional area at the second free end are substantially parallel to the longitudinal axis of the head. In other words, the filament may be fixed to the bristle carrier in a manner that higher bending stiffness is provided in a brushing direction where the risk of injury to gums is relatively low, like in a direction parallel to the longitudinal extension of the head in order to clean the occlusal, buccal and lingual surfaces of the teeth with higher brushing force in a longitudinal brushing direction. This filament configuration may further facilitate penetration of the filament's free ends into interdental areas when the head for the oral-care implement is moved both, in a forward and a backward brushing direction along the longitudinal extension of the head. The increase of bending stiffness along the longer diameter may force the filament's free ends to slide into the interdental areas more easily when the head is moved in these two opposite directions.

In addition or alternatively, the first free end and the second free end of the at least one filament may be arranged in a manner that the shorter diameter of the cross-sectional area at the first free end and the shorter diameter of the cross-sectional area at the second free end are substantially orthogonal to the longitudinal axis of the head. Thus, lower bending stiffness may be provided in a brushing direction orthogonal to the longitudinal extension of the head in order to provide more gentle brushing when the head is moved from the teeth to the gums and vice versa. In other words, the bending stiffness may be higher in the direction along the occlusal, buccal and lingual surfaces of the teeth, while the bending stiffness is lower when the filament is moved in a sideward direction, i.e. between the teeth and the gums and vice versa. The lower bending stiffness in the sideward direction may reduce the risk of injury of gums and/or other soft tissues of the oral cavity. In other words, the head for the oral-care implement may ensure high cleaning performance for forth and back movement while the lower bending stiffness in the sideward direction may protect the gums.

The free ends of the filament may be twisted around the longitudinal axis in a discrete or continuous manner. The filament according to the present disclosure may be manufactured by extruding a monofilament having a non-circular cross-sectional area. After extruding, the monofilament may be pre-stretched accompanied by a reduction in its cross-sectional area, which may be followed by further stretching. Following the stretching, the filament may be twisted in a manner that both ends of the filament are twisted around the filament's longitudinal axis by a twisting angle of about 80° to about 100°, optionally about 90°. The filament may be stabilized by shrinkage, for example via heat application.

In case the free ends are twisted around the filament's longitudinal axis in a continuous manner, the at least one filament can be easily mixed with other filament types, e.g. having a cross-sectional area being different to the cross-sectional area of the filament according to the present disclosure. The free ends of said at least one further filament may be twisted around the filament's longitudinal axis by a twisting angle $\alpha$ of about 90° to about 100°, optionally about 90°, or alternatively, the said filament may have a non-twisted configuration. Mixing of different filament types may be facilitated since the distance over which the twisting occurs may be relatively long compared to a discrete twisting method. Further, usage of filaments having different geometries of the cross-sectional area may facilitate feeding of the tufting machine.

For example, the at least one further filament may have a substantially circular cross-sectional area. The ratio of the number of filaments according to the present disclosure to the number of filaments having a substantially circular cross-sectional area may be about 1:1. Such ratio may provide a relatively dense tuft structure. In other words, such ratio may allow a relatively high packing factor of the filaments within the tuft since gaps/voids between adjacent filaments may be minimized. The filaments may be arranged in close proximity. In the context of this disclosure the term "packing factor" means the sum of all cross-sectional areas of the filaments divided by the cross-sectional area of the overall tuft. A high packing factor of filaments may provide improved brushing effectiveness, i.e. better removal of plaque and debris from the teeth's surface and gums. In other words, the number of filaments within a given area can be maximized to improve cleaning properties. Further, a relatively dense filament pattern, i.e. filaments being arranged in close proximity may provide a capillary action which may enable the dentifrice to flow towards the tip/free end of the filaments and, thus, may make the dentifrice more available to the teeth and gums during brushing.

The filaments may be arranged within the tuft in a randomized or aligned manner. In case the filaments are arranged in a randomized manner, the packing factor of the filaments within the tuft may be even higher. Further, a randomized alignment of filaments having a non-circular cross-sectional area in accordance to the present disclosure may provide a tuft comprising a plurality of filaments having anisotropic bending stiffness properties in different directions. Such arrangement may improve cleaning properties in various directions. For example, different types of teeth, e.g. molars, premolars and incisors along with different types of tooth surfaces, e.g. buccal, lingual, maxillary and mandibular surfaces may be cleaned in an even more efficient manner.

The at least one tuft may have a longitudinal axis and a non-circular cross-sectional area extending in a plane perpendicular to the longitudinal axis. In other words, the cross-sectional area of the tuft may have a longer diameter and a shorter diameter lying in said plane. For example, the ratio of the length of the shorter diameter to the length of the longer diameter may be about 0.6 to about 0.8. The non-circular cross-sectional area may provide the tuft with anisotropic bending stiffness. For example, the non-circular cross-sectional area of the tuft may be oval/ellipsoid, squared, rectangular, triangular, cross-shaped, or it can be a prolate ellipsoid with flattened long sides, even though other shapes may be considered, as well. An oval shape may further facilitate correct alignment of the at least one filament according to the present disclosure with respect to the anchor. The filament(s) may be fixed in the tuft hole in a manner that the longer diameter of the filament's cross-sectional area (in the tuft hole) is substantially parallel to the upper top surface of the bristle carrier. The anchor may be aligned substantially parallel to the longer diameter of the tuft's cross-sectional area.

The tuft may be arranged on the bristle carrier of the head in a manner that higher bending stiffness is provided in a direction where higher cleaning forces may be needed. Lower bending stiffness may be provided in a direction where gentle cleaning forces or a massaging effect may be required. For example, the cross-sectional area of the tuft may be oval and the longest diameter thereof may be aligned with respect to the longitudinal extension of the head in a substantially parallel manner. Thus, higher bending stiffness may be provided in a direction parallel to the longitudinal extension of the head and lower bending stiffness orthogonal thereto. This may provide gentle cleaning properties and a massaging effect when the head is moved from the teeth to the gums and vice versa, while higher bending stiffness may be provided in the longitudinal brushing direction to clean along the occlusal, buccal and lingual surfaces of the teeth. In addition, since the filament's bending stiffness is increased in said longitudinal brushing direction, the filament's free ends may enter interdental spaces with its shorter sides more easily.

The at least one filament may be made of nylon with or without an abrasive such as kaolin clay, polybutylene terephtalate (PBT) with or without an abrasive such as kaolin clay and/or from nylon indicator material colored at the outer surface. The coloring on the nylon indicator material may be slowly worn away as the filament is used over time to indicate the extent to which the filament is worn.

The oral-care implement may be a toothbrush comprising a handle and a head according to any of the embodiments described above. The head extends from the handle and may be either repeatedly attachable to and detachable from the handle or the head may be non-detachably connected to the handle. The toothbrush may be an electrical or a manual toothbrush.

The bristle carrier may have a substantially circular or oval shape. Such a bristle carrier may be provided for an electrical toothbrush which may perform a rotational oscillation movement. The bristle carrier of an electrical toothbrush can be driven to rotate about and to move axially along an axis of movement in an oscillating manner, wherein such axis of movement may extend substantially perpendicular to the plane defined by the upper top surface of the bristle carrier. One or more tuft(s) comprising a plurality of filaments according to the present disclosure may be attached to the bristle carrier. Said tuft(s) may allow the filaments free ends to penetrate into interdental areas and hard to reach regions more easily during the rotational oscillation movement of the head which may provide further improved cleaning properties of the head. Plaque and other residues may be loosened by the oscillating action of the filaments being substantially perpendicular to the tooth surfaces, whereas the rotational movement may sweep the plaque and further residues away. A randomized alignment of the filaments according to the present disclosure may provide even more efficient plaque removal effects and interdental penetration properties during a rotational oscillation brushing motion. For various cleaning positions, e.g. at buccal, lingual and occlusal surfaces of molars, premolars, incisors, maxillary and mandibular teeth, an adequate amount of filaments may be provided to facilitate both, improved interdental and outer surface cleaning properties.

The following is a non-limiting discussion of example embodiments of oral-care implements and parts thereof in accordance with the present disclosure, where reference to the Figures is made.

FIG. 1 shows a perspective view of an embodiment of an oral-care implement 10 which could be a manual or an electrical toothbrush 10 comprising a handle 12 and a head 14 extending from the handle 12 in a longitudinal direction. The head 14 has a proximal end 41 close to the handle 12 and a distal end 40 furthest away from the handle 12, i.e. opposite the proximal end 41. The head 14 has substantially the shape of an oval with a length extension 52 and a width extension 51 substantially perpendicular to the length extension 52. A plurality of tufts 16 comprising a plurality of filaments 24 may be secured to the head 14 by means of a stapling process utilizing an anchor 18 that may be pushed into respective tuft holes 20 provided in the bristle carrier 22 of the head 14. For the sake of simplicity, only one tuft 16 is shown in FIG. 1.

Figure 2:
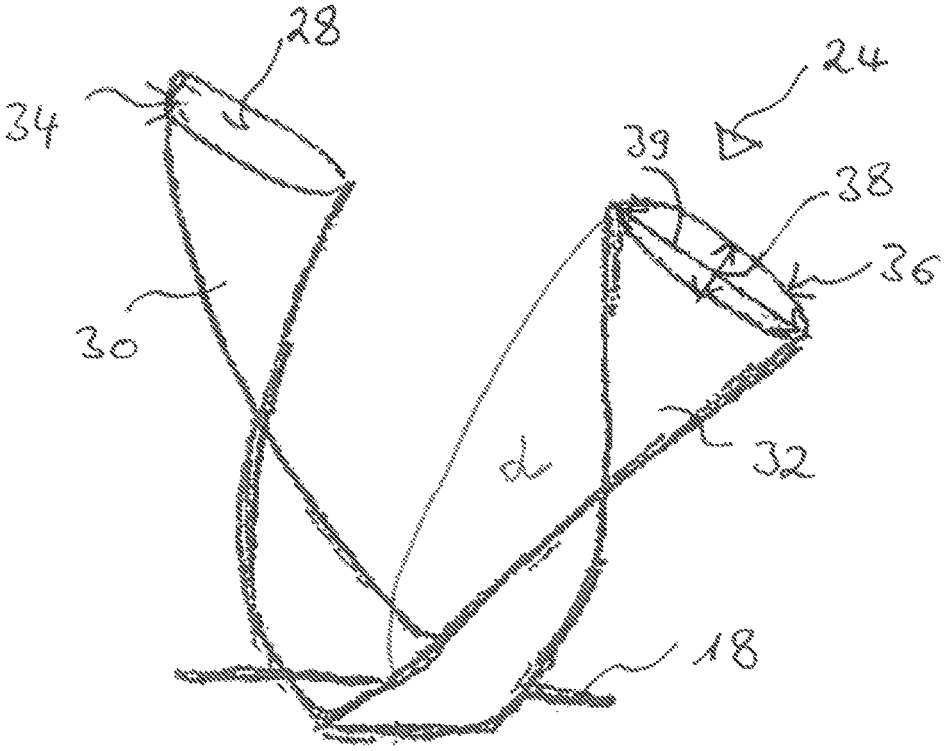
FIG. 2 shows a schematic perspective view of a filament as shown in FIG. 1.
Figure 3:
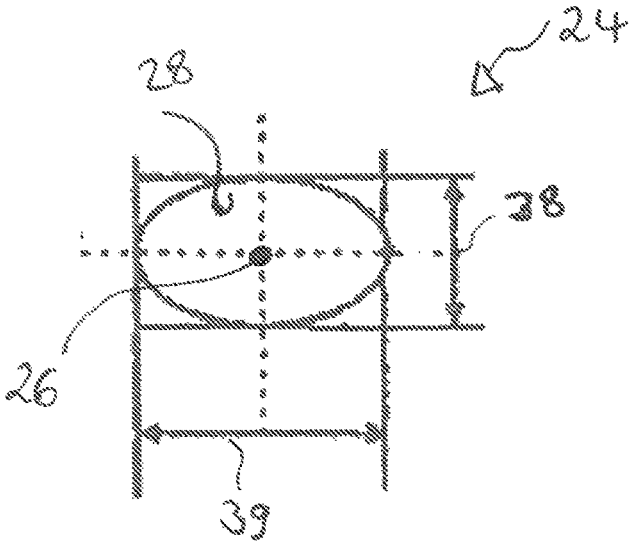
FIG. 3 shows a schematic top-down view on one of the free ends of the filament as shown in FIG. 2.
Figure 4:
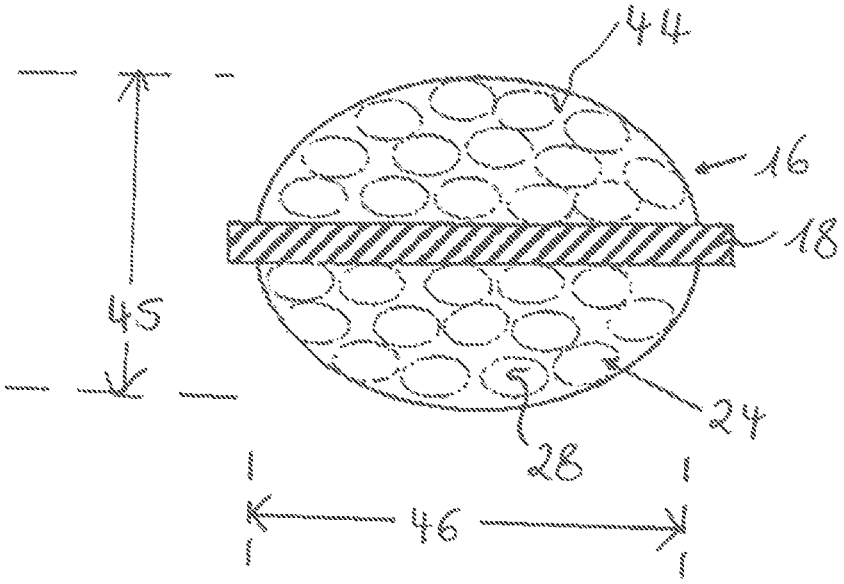
FIG. 4 shows a schematic top-down view of the tuft as shown in FIG. 1.

One of the filaments 24 fixed to the bristle carrier 22 is shown in FIGS. 2 and 3 in a perspective and schematic top down view, respectively, while tuft 16 is shown in FIG. 4. Filament 24 comprises a longitudinal axis 26 and a non-circular cross-sectional area 28 extending in a plane substantially perpendicular to said longitudinal axis 26. As shown in FIG. 2 the filament 24 is folded across its longitudinal axis 26 and is bent around the anchor 18 so that a first limb 30 and a second limb 32 extend from the bristle carrier 22 (cf. FIG. 1). The first limb 30 and the second limb 32 comprise a first free end 34 and a second free end 36, respectively, which ends 34, 36 usually come in direct contact with teeth surfaces and/or gums during a brushing action. Each free end 34, 36 is twisted around the filament's longitudinal axis 26 by a twisting angle $\alpha$ of about 80° to about 100°, optionally about 90° in a discrete or continuous manner.

The non-circular cross-sectional area 28 has a substantially oval shape comprising a shorter diameter 38 and a longer diameter 39. The ratio of the length of the shorter diameter 38 to the longer diameter 39 may be about 0.6 to about 0.8. The filaments 24 are arranged in a manner that the longer diameter 39 of the first free end 34 and the second free end 36, respectively, are substantially parallel to the longitudinal axis 42 of the head 14 to provide higher brushing forces when the head 14 is moved along its longitudinal axis 42 in a longitudinal brushing direction. The occlusal, buccal and lingual surfaces of the teeth can be cleaned with higher forces and the filaments can be forces to penetrate more easily into interdental areas. The shorter diameter 38 of the first free end 34 and the second free end 36, respectively, are substantially orthogonal to the longitudinal axis 42 of the head 14 to provide more gentle brushing properties along with a massaging effect when the head 14 is moved from the teeth to the gums and vice versa. The free ends 34, 36 of the filaments 24 are orientated substantially in the same direction.

The tuft 16 as shown in FIGS. 1 and 4 has a longitudinal axis 43 and a non-circular cross-sectional area 44 extending in a plane substantially perpendicular to said longitudinal axis 43. The shape of the non-circular cross-sectional area 43 is substantially oval and comprises a shorter diameter 45 and a longer diameter 46. The ratio of the length of the shorter diameter 45 to the longer diameter 46 may be about 0.6 to about 0.8. The tuft 16 is arranged in a manner that the longer diameter 46 is substantially parallel to the longitudinal axis 42 of the head 14. The shorter diameter 45 is substantially orthogonal thereto.

Figure 5:
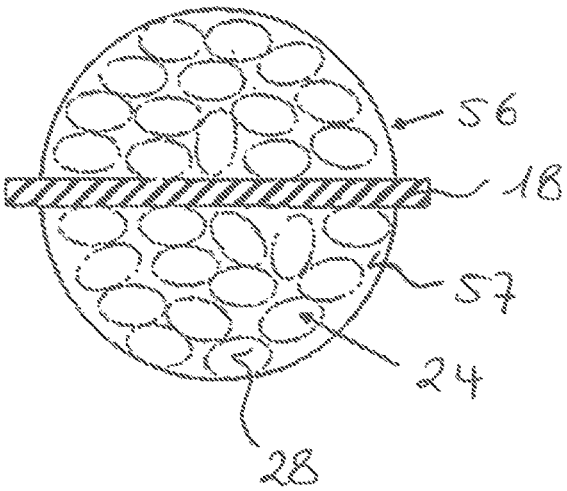
FIG. 5 shows a schematic top-down view of a second example embodiment of a tuft.

A second embodiment of a tuft 56 is shown in FIG. 5. Tuft 56 comprises a plurality of filaments 24 as shown in FIGS. 2 and 3, the filaments 24 being orientated in a randomized manner. In other words, the orientation of the free ends 34, 36 within the tuft 56 is randomized. Tuft 56 has a substantially circular cross-sectional area 57.

Figure 6:
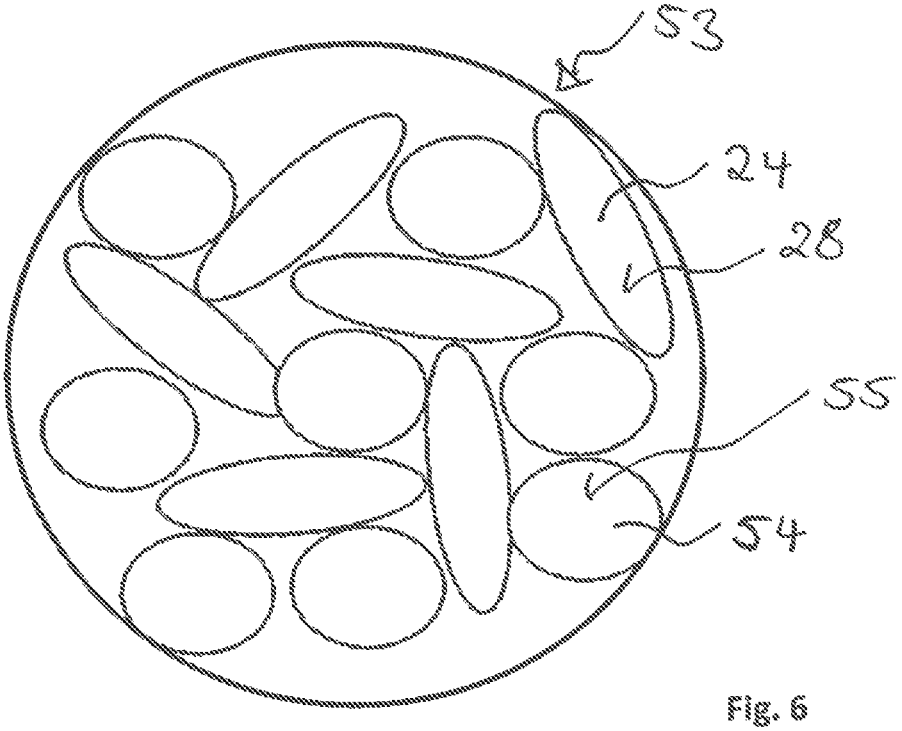
FIG. 6 shows a schematic top-down view of a third example embodiment of a tuft.

A third embodiment of a tuft 53 as shown in FIG. 6 comprises both, filaments 24 as shown in FIGS. 1 and 2 and filaments 54 having a substantially circular cross-sectional area 55. The ratio of the number of filaments 24 as shown in FIGS. 1 and 2 to the number of filaments 54 having a substantially circular cross-sectional area 55 may be about 1:1. The free ends of the filaments 54 having a substantially circular cross-sectional area may be twisted around the filaments' longitudinal axis by a twisting angle α of about 90° to about 100°, optionally about 90°, or alternatively, the said filaments 54 may be provided in a non-twisted configuration. The orientation of the free ends 34, 36 of the filaments 24, 54 within the tuft 53 is randomized in order to provide a relatively high packing factor of the filaments 24, 54 within the tuft 53.

In the context of this disclosure, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

What is claimed is:

1. A head for an oral-care implement comprising a longitudinal axis and a bristle carrier having at least one tuft hole and at least one tuft being fixed in said tuft hole by an anchor, the at least one tuft comprising at least one filament having a longitudinal axis and a non-circular cross-sectional area extending in a plane substantially perpendicular to the longitudinal axis, the at least one filament being bent around the anchor so that a first limb and a second limb extend from the bristle carrier, the first limb comprising a first free end and the second limb comprising a second free end and each free end is twisted around the longitudinal axis by a twisting angle α of about 80° to about 100°, wherein the non-circular cross-sectional area of the at least one filament comprises a shorter diameter and a longer diameter of the filament with a ratio of the shorter diameter to the longer diameter of the filament is from about 0.6 to about 0.8, and wherein the non-circular cross-sectional area of the at least one filament has a substantially oval shape.

2. The head according to claim 1, wherein the first free end and the second free end of the at least one filament are arranged such that the longer diameter at the first free end and the longer diameter at the second free end are substantially parallel to the longitudinal axis of the head.

3. The head according to claim 1, wherein the first free end and the second free end of the at least one filament are arranged in such that the shorter diameter at the first free end and the shorter diameter at the second free end are substantially orthogonal to the longitudinal axis of the head.

4. The head according to claim 1, wherein the free ends of the at least one filament are twisted around the longitudinal axis discretely.

5. The head according to claim 1, wherein the free ends of the at least one filament are twisted around the longitudinal axis continuously.

6. The head according to claim 1, wherein the at least one tuft has a longitudinal axis and a non-circular cross-sectional area extending in a plane substantially perpendicular to the longitudinal axis of the tuft.

7. The head according to claim 6, wherein the non-circular cross-sectional area of the at least one tuft comprises a shorter diameter and a longer diameter, and a ratio of the shorter diameter of the tuft to the longer diameter of the tuft is from about 0.6 to about 0.8.

8. The head according to claim 6, wherein the non-circular cross-sectional area of the tuft has a substantially oval shape.

9. The head according to claim 1, wherein the at least one tuft comprises at least one further filament having a longitudinal axis and a cross-sectional area extending in a plane substantially perpendicular to the longitudinal axis, wherein the cross-sectional area of said at least one further filament is different from the non-circular cross-sectional area of the at least one filament.

10. The head according to claim 9, wherein the tuft comprises a plurality of filaments having a non-circular cross-sectional area and a plurality of filaments having a substantially circular cross-sectional area.

11. The head according to claim 10, wherein a ratio of a number of the filaments having the non-circular cross-sectional area to a number of the filaments having the substantially circular cross-sectional area is about 1:1.

12. The head according to claim 9, wherein orientation of the filaments within the at least one tuft is randomized.

13. The head according to claim 1, wherein orientation of the filaments within the at least one tuft is randomized.

14. An oral-care implement comprising the head according to claim 1.

15. A head for an oral-care implement comprising a longitudinal axis and a bristle carrier having at least one tuft hole and at least one tuft being fixed in said tuft hole by an anchor, the at least one tuft comprising at least one filament having a longitudinal axis and a non-circular cross-sectional area extending in a plane substantially perpendicular to the longitudinal axis and at least one filament having a longitudinal axis and circular cross-sectional area extending in a plane substantially perpendicular to the longitudinal axis, the filaments being bent around the anchor so that a first limb and a second limb extend from the bristle carrier, the first limb comprising a first free end and the second limb comprising a second free end, wherein each free end of the non-circular filament is twisted around the longitudinal axis by a twisting angle α of about 80° to about 100°, and wherein the non-circular cross-sectional area of the at least one filament comprises a shorter diameter and a longer diameter of the filament with a ratio of the shorter diameter to the longer diameter of the filament is from about 0.6 to about 0.8.

* * * * *